United States Patent [19]

Weiss et al.

[11] Patent Number: 4,789,210

[45] Date of Patent: Dec. 6, 1988

[54] MOVABLE CABINETRY SYSTEM FOR ENCLOSURES

[75] Inventors: Morton A. Weiss, West Orange; Robert F. Weiskopf, Springfield, both of N.J.

[73] Assignee: White Home Products Inc., Atlanta, Ga.

[21] Appl. No.: 142,636

[22] Filed: Jan. 11, 1988

[51] Int. Cl.[4] ..... A47B 53/00

[52] U.S. Cl. ..... 312/201; 312/346

[58] Field of Search ..... 312/198, 199, 201, 250, 312/343, 375, 350, 349, 346, 342

[56] References Cited

U.S. PATENT DOCUMENTS

| | | | |
|---|---|---|---|
| 2,000,463 | 5/1935 | Browne | 312/346 |
| 3,967,868 | 7/1976 | Baker | 312/198 X |
| 4,467,924 | 8/1984 | Marcheles | 312/198 X |

OTHER PUBLICATIONS

Slimstak, The Space Saving Modular Filing System, Nov. 19, 1939.

*Primary Examiner*—Joseph Falk

*Attorney, Agent, or Firm*—Lerner, David, Littenberg, Krumholz & Mentlik

[57] ABSTRACT

A movable cabinetry system is provided for an enclosure having an elongate wall, a floor, door means for gaining access to the enclosure, and stationary cabinetry having elongate front and back portions, the back portion of which is positioned along and fixed in place relative to the elongate wall. The movable cabinetry system comprises a track assembly positioned on the floor adjacent to and co-extensive with at least a major portion of the elongate front portion of the stationary cabinetry; and at least one carriage assembly longitudinally movable on the track assembly and adapted to support a cabinet thereon for longitudinal movement therewith. The carriage assembly has a longitudinal length no greater than about one-half the length of the front portion of the stationary cabinetry so that a cabinet supported by the carriage assembly and having a longitudinal length no greater than about the longitudinal length of the carriage assembly can be moved relative to the stationary cabinetry to allow access to substantially all of the front portion of the stationary cabinetry. The movable cabinetry system further includes interlocking means carried by the carriage assembly and the track assembly for inhibiting tilting of the carriage assembly with respect to the track assembly.

10 Claims, 7 Drawing Sheets

MOVABLE CABINETRY SYSTEM FOR ENCLOSURES

FIELD OF THE INVENTION

The present invention relates to movable cabinetry systems for enclosures and, more particularly, to movable cabinetry systems for enclosures that also have stationary cabinetry therein.

BACKGROUND OF THE INVENTION

Enclosures such as closets, pantries, storerooms and the like in homes, offices, factories and stores are often provided with fixed or stationary cabinets, shelves, racks, bins garment rods or hooks (hereinafter collectively referred to as "cabinetry") along one or more of the walls thereof. Such enclosures conventionally include wasted walk-in space that is provided therein to allow the user to have access to all parts of the stationary cabinetry in the enclosure. Where the enclosure is designed to have a given amount of storage space, this results in a loss of useable living space outside of the enclosure since the enclosure must be made large enough for the user to enter the same to have access to all parts of the stationary cabinetry therein. Alternatively, if a given amount of space is provided for the enclosure, a loss of available storage space results from the need to provide the walk-in space for the user to have the requisite full access to the stationary cabinetry in the enclosure.

In order to achieve significantly improved storage efficiency so that either a given enclosure space can have greater useable storage space, in the case of existing structures, or so that less enclosure space need be allocated for a given amount of required storage space, in the case of planned future constructions, it has been found desirable to place cabinetry that is movable on tracks in front of the stationary cabinetry, in the formerly wasted walk-in space of such enclosures. Since such movable cabinetry is not fastened to the walls or floor of the enclosure and might tilt, or tip over, causing injury, in the event a heavily loaded drawer thereof is extended fully out of the cabinetry or the cabinetry is accidentally pushed over from its side, it has also been found desirable to provide means in the movable cabinetry system for inhibiting such tilting of the movable cabinetry.

It is, therefore, a primary object of the present invention to provide improved movable cabinetry systems for enclosures having stationary cabinetry therein.

Another object of the invention is to provide movable cabinetry systems that achieve greater efficiency in the utilization of storage space in enclosures having stationary cabinetry therein.

A further object of the invention is to provide improved movable cabinetry systems employing tracks and carriages which include tilt-inhibiting means formed therein to prevent the movable cabinets from being inadvertently tilted off of their tracks by the user.

Additional objects and advantages of this invention will become apparent as the following description proceeds.

SUMMARY OF THE INVENTION

Briefly stated, and in accordance with one embodiment of this invention, a movable cabinetry system is provided for an area having an elongate wall, a floor, and stationary cabinetry having elongate front and back portions, the back portion of which is positioned along and fixed in place relative to the elongate wall. The movable cabinetry system comprises a track assembly positioned on the floor adjacent to and co-extensive with at least a major portion of the elongate front portion of the stationary cabinetry; and at least one carriage assembly longitudinally movable on the track assembly and adapted to support a cabinet thereon for longitudinal movement therewith. The carriage assembly has a longitudinal length no greater than about one-half the length of the front portion of the stationary cabinetry so that a cabinet supported by the carriage assembly and having a longitudinal length no greater than about the longitudinal length of the carriage assembly can be moved relative to the stationary cabinetry to allow access to substantially all of the front portion of the stationary cabinetry. The movable cabinetry system preferably further includes interlocking means carried by the carriage assembly and the track assembly for inhibiting tilting of the carriage assembly with respect to the track assembly.

BRIEF DESCRIPTION OF THE DRAWINGS

While the specification concludes with claims particularly pointing out and distinctly claiming the subject matter regarded as the invention herein, it is believed that the present invention will be more readily understood from the following description, taken in conjunction with the accompanying drawings, in which:

DETAILED DESCRIPTION OF THE INVENTION

Figure 1:
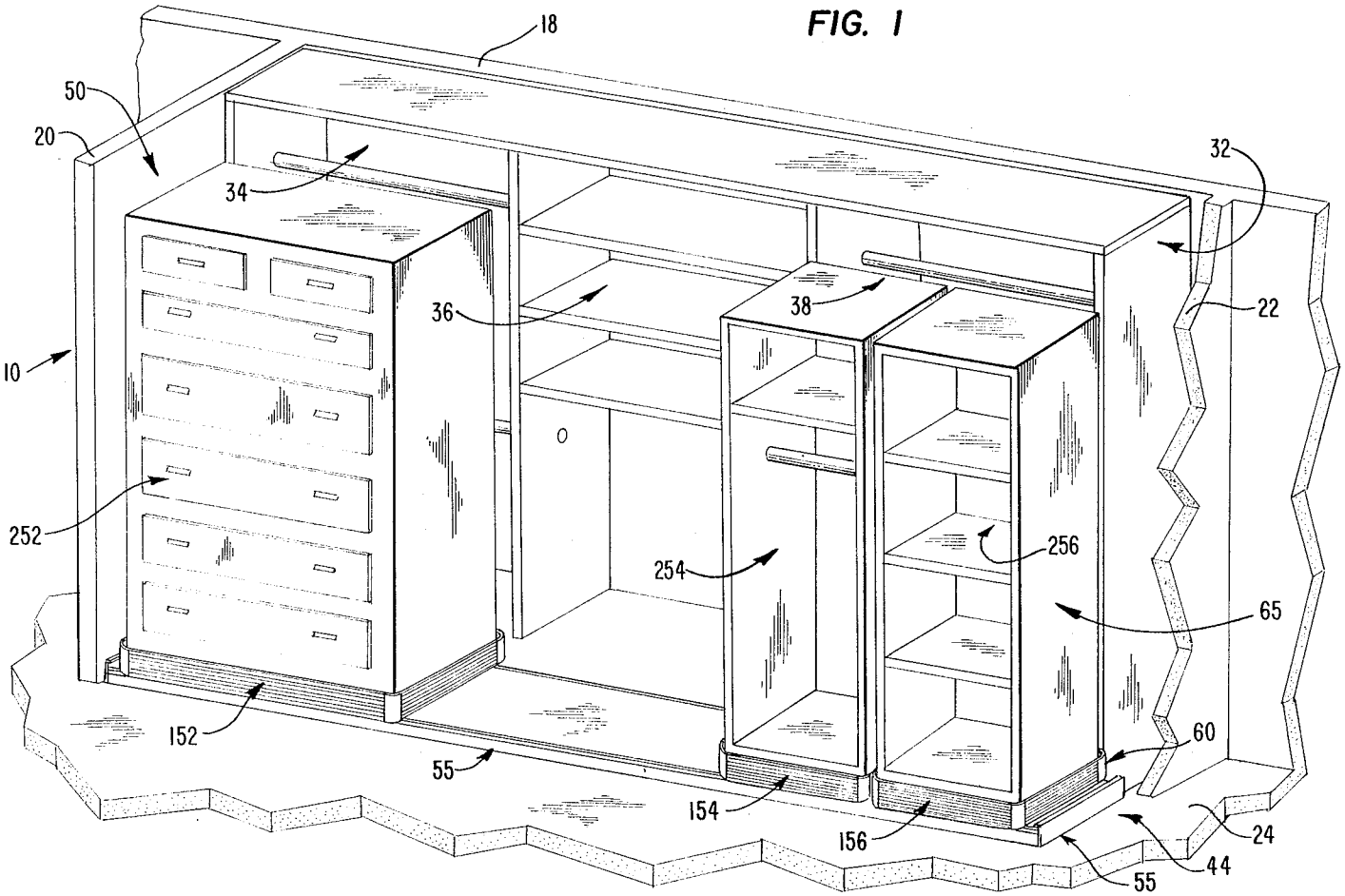
FIG. 1 is a perspective view, with parts omitted and broken away for clarity, of an enclosure that is provided both with conventional stationary cabinetry therein and with a movable cabinetry system in accordance with the present invention.
Figure 2:
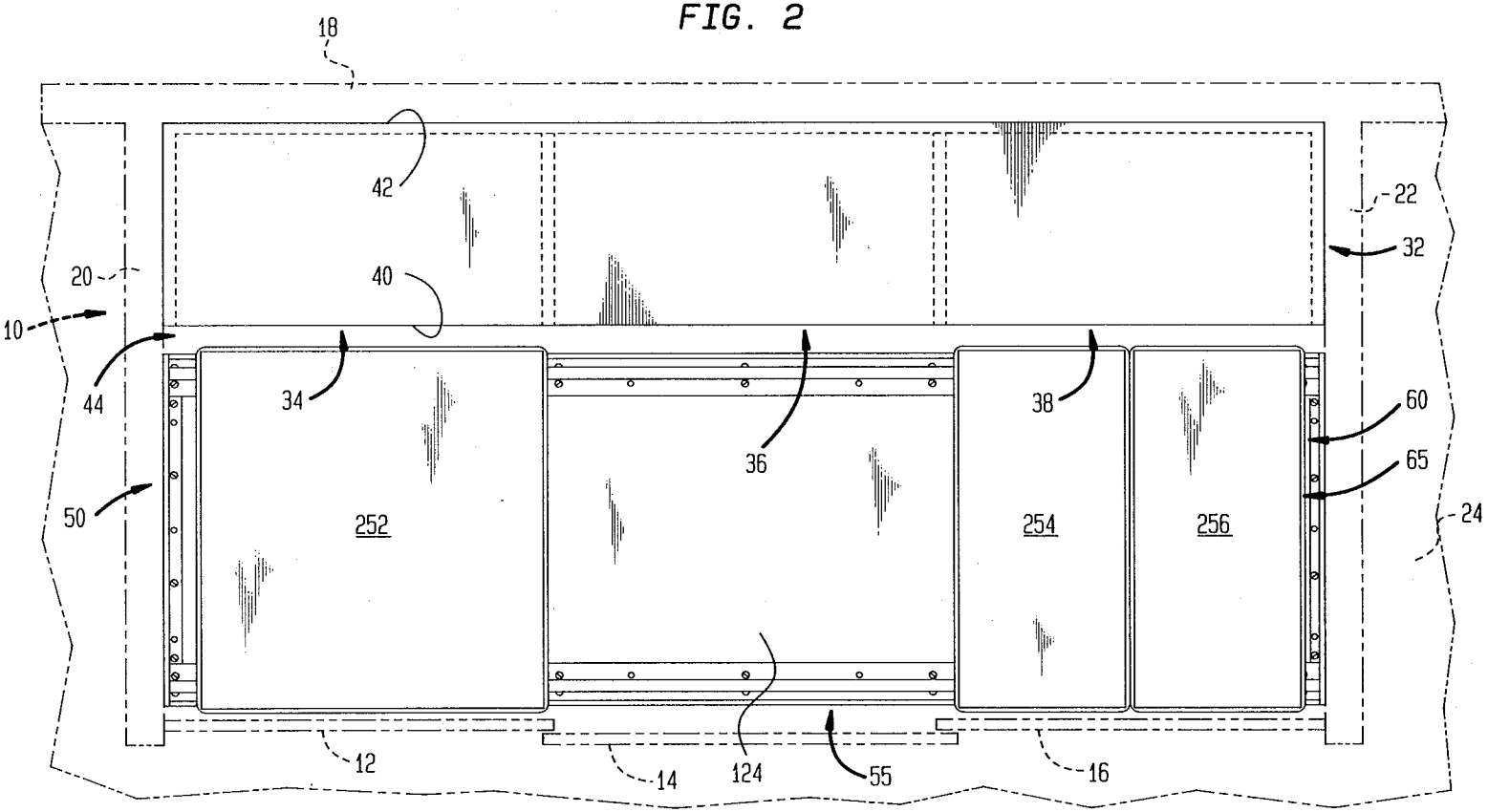
FIG. 2 is a plan view, with parts omitted for clarity, of the enclosure and movable cabinetry system of FIG. 1.
Figure 3:
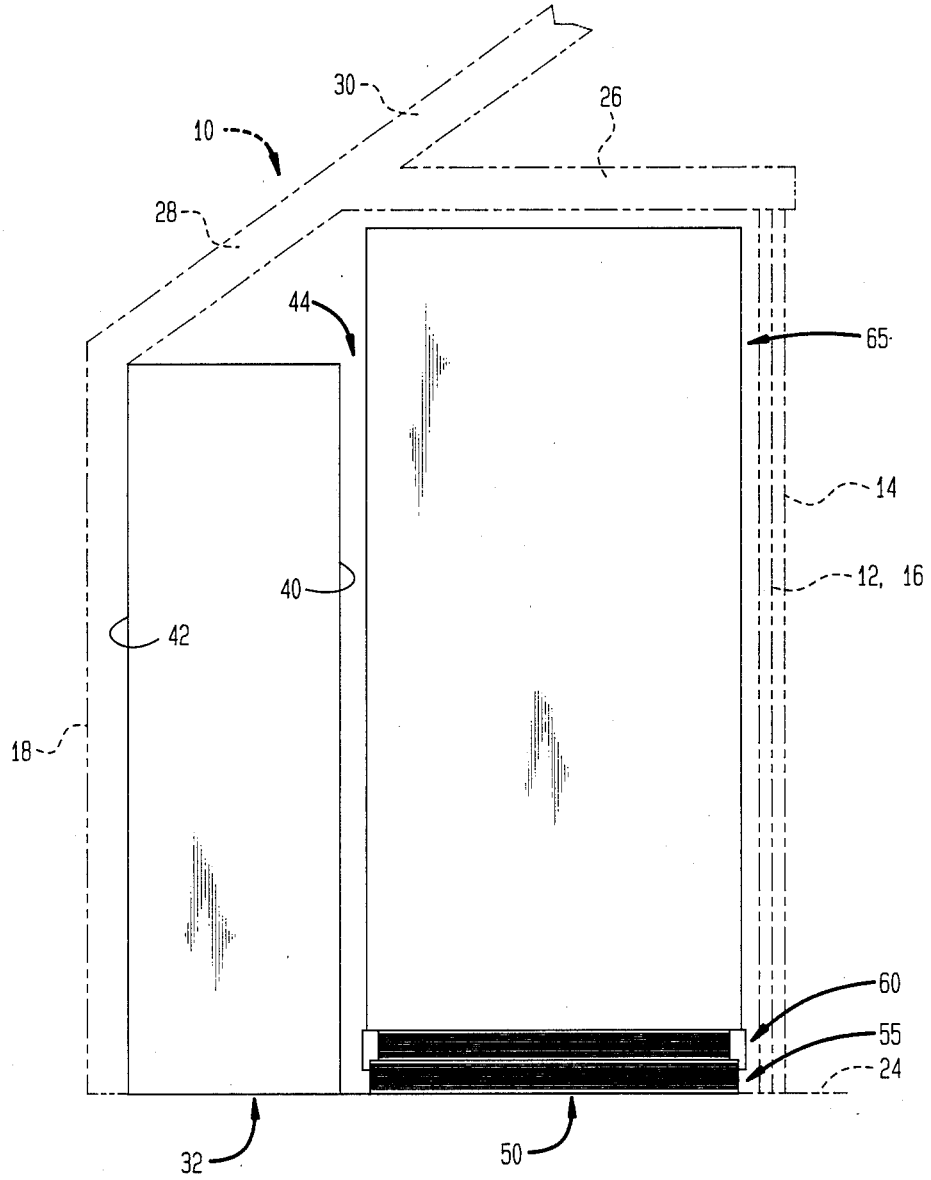
FIG. 3 is an end elevation view, with parts omitted for clarity, of an enclosure used in a sloped roof house, and illustrating a movable cabinetry system for such enclosure that has a greater height than that of the stationary cabinetry therein.

Referring to FIGS. 1-3, the present invention has been illustrated in connection with its use in an enclosure, shown generally at 10, which in the present case comprises a typical closet having three sliding doors 12, 14 and 16 that provide access to various parts of the enclosure 10. The enclosure or closet 10 includes an elongate rear wall 18, relatively shorter side walls 20 and 22, a floor 24 and, in the case of the enclosure 10 shown in FIG. 3, a ceiling, having a portion 26 thereof which is parallel to the floor 24 and forms a continuation of the ceiling of the room in which access to the enclosure 10 is obtained, and having a portion 28 thereof which is angularly disposed relative to the floor 24 since it is formed by the slanted roof 30 of the building in which the enclosure is located.

Stationary cabinetry, shown generally at 32, is provided in the closet 10. The illustrative stationary cabinetry 32 comprises three rigidly interconnected portions, including a first end rack portion, shown generally at 34, a central shelf portion, shown generally at 36, and a second end rack portion, shown generally at 38. One or more of the various portions 34, 36 and 38 of the stationary cabinetry could equally as well comprise a cabinet having a plurality of drawers therein, the actual configuration illustrated being selected merely for convenience of illustration.

The stationary cabinetry 32 includes a front portion 40 thereof and a rear portion 42 thereof. It is bolted or otherwise fastened to one or more of the floor 24 and the walls 18–22, with its rear portion 42 abutting wall 18. The cabinetry 32 is rigidly fixed in its position within the enclosure 10 in accordance with normal construction practices.

Typically enclosures such as oversize closets, walk-in closets, pantries and store rooms include open aisle space intended for the user to gain access to various parts of the stationary cabinetry located within the enclosure. Such aisle space in the enclosures 10 illustrated in FIG. 1–3 comprises the space that is located between the front portion 40 of the stationary cabinetry 32 and the doors 12–16, which space has been designated generally at 44. In a walk-in closet (not shown) the aisle space generally extends from a door at one side or end thereof to the opposite side or end of the enclosure, in front of the stationary cabinetry.

In accordance with the present invention the aisle space 44 is utilized to provide a movable cabinetry system, shown generally at 50, in the enclosure 10. The movable cabinetry system 50 includes a longitudinally elongate track assembly shown generally at 55, a plurality of carriage assemblies, shown generally at 60, which are longitudinally movable on the track assembly 55 and are adapted to support corresponding cabinets, shown generally at 65, thereon for longitudinal movement therewith, and, referring to FIG. 6, means, shown generally at 70 and 75, carried by the respective assemblies 55 and 60 and engagable with the other of the assemblies 55 and 60, for inhibiting tilting of the carriage assemblies with respect to the track assembly.

Referring more particularly to FIGS. 4–8, the longitudinally elongate track assembly 55 comprises a longitudinally elongate, generally rectangular platform member or base member 80 having transversely spaced side edges 82 and 84 and longitudinally spaced end edges 86 and 88, an upper surface 90 and a lower surface 92. Track members, shown generally at 94 and 96, are provided in track assembly 55. The track members 94 and 96 preferably comprise elongate extrusions, each of which includes a downwardly extending leg 98 (FIGS. 6 and 7) adapted to overlie the side edges 82 and 84 of the platform member 80, a horizontally extending leg 100 adapted to overlie corresponding marginal portions 101 of the upper surface 90 of platform member 80, and an upwardly projecting rail 102 having an arcuate upper portion 104 on which the carriages 60 are supported. The track members 94 and 96 are fastened to the outer marginal portions 101 of the platform member 80 by means of screws 106.

The track assembly 55 also includes a pair of transversely spaced cover strips, shown generally at 108 and 110, which are fastened by means of screws 112 to the platform member 80 adjacent to and parallel to the respective track members 94 and 96. The transversely spaced cover strips 108 and 110 are preferably elongate metallic extrusions which each include a horizontal leg portion 114 (FIG. 6) and a raised lip portion 116 which, when the track members 94 and 96 and the cover strips 108 and 110 are fastened in place on the platform member 80, forms an outwardly opening channel, shown generally at 120, that forms part of the tilt inhibiting means 70 on the track assembly 55. Each of the cover strips 108 and 110 includes a recessed portion 122 therein which is adapted to overlie a decorative panel, for example linoleum, that covers the otherwise exposed upper surface 90 of the platform member 80. The platform member 80, in turn, is preferably made of particle borad, or plywood, or aluminum, to facilitate the entry of the various locking screws 106 and 112 thereinto. The various extrusions 94, 96, 108 and 110 are preferably aluminum extrusions.

Figure 10:
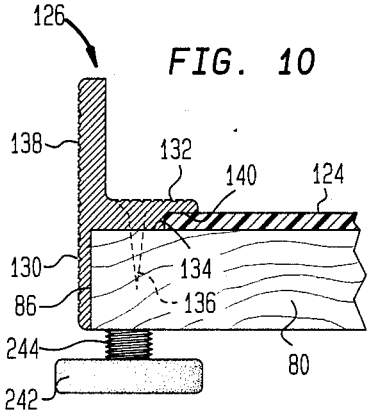
FIG. 10 is an enlarged sectional elevation view, taken along the line 10—10 of FIG. 4.

The track assembly 55 is also provided with end cap members 126 and 128 at the opposite ends of the platform member 80. Referring to FIG. 10, each of the end cap members 126 and 128 includes a downwardly extending lower leg portion 130, which abuts against the corresponding end edge 86 and 88 of the platform member 80, a horizontally extending leg portion 132, which overlies a marginal end portion 134 of platform member 80 and is fastened thereto by means of screws 136, and an upwardly extending leg portion 138, which serves as an abutment to limit the travel of the carriage assemblies 60 on the track assembly 55. The end cap members 126 and 128 are recessed at 140 to receive and hold down longitudinal end portions of the decorative panel 124. In addition, referring to FIG. 4, the horizontal leg portions 132 of each of end caps 126 and 128 are notched, as shown at 142, at each of their ends to receive end portions of the track members 94 and 96 and end portions of the cover strip members 108 and 110 therein. The end cap members 126 and 128 are preferably formed from aluminum extrusions.

Referring now to FIGS. 4–9, the carriage assembly 60 will now be described in greater detail. In the embodiment shown three carriage assemblies 152, 154 and 156 have been illustrated. The various carriage assemblies 152, 154 and 156 are generally of similar construction to one another, except for the longitudinal lengths thereof, and thus a description of one of the carriage assemblies, carriage assembly 152, will suffice for each of the assemblies.

The carriage assembly 152 includes a pair of transversely spaced apart, longitudinally extending side members 160 and 162, each of which (FIG. 6) includes a pair of downwardly extending leg portions, including an inboard leg portion 164 and an outboard leg portion 166. The carriage side members 160 and 162 also each include a horizontal leg portion 168 which, together with the leg portions 164 and 166, forms an inverted "U"-shaped channel. The side members 160 and 162 also each include an upwardly extending leg portion 170.

The carriage assembly 152 is further provided with a pair of longitudinally spaced apart, transversely extending end members 172 and 174, each of which includes downwardly extending inboard and outboard leg portions 176 and 178 (FIG. 9) corresponding to the downwardly extending leg portions 164 and 166 of the side members 160 and 162. The carriage end members 172 and 174 also include horizontally extending leg portions 180 and upwardly extending leg portions 182.

Figure 4:
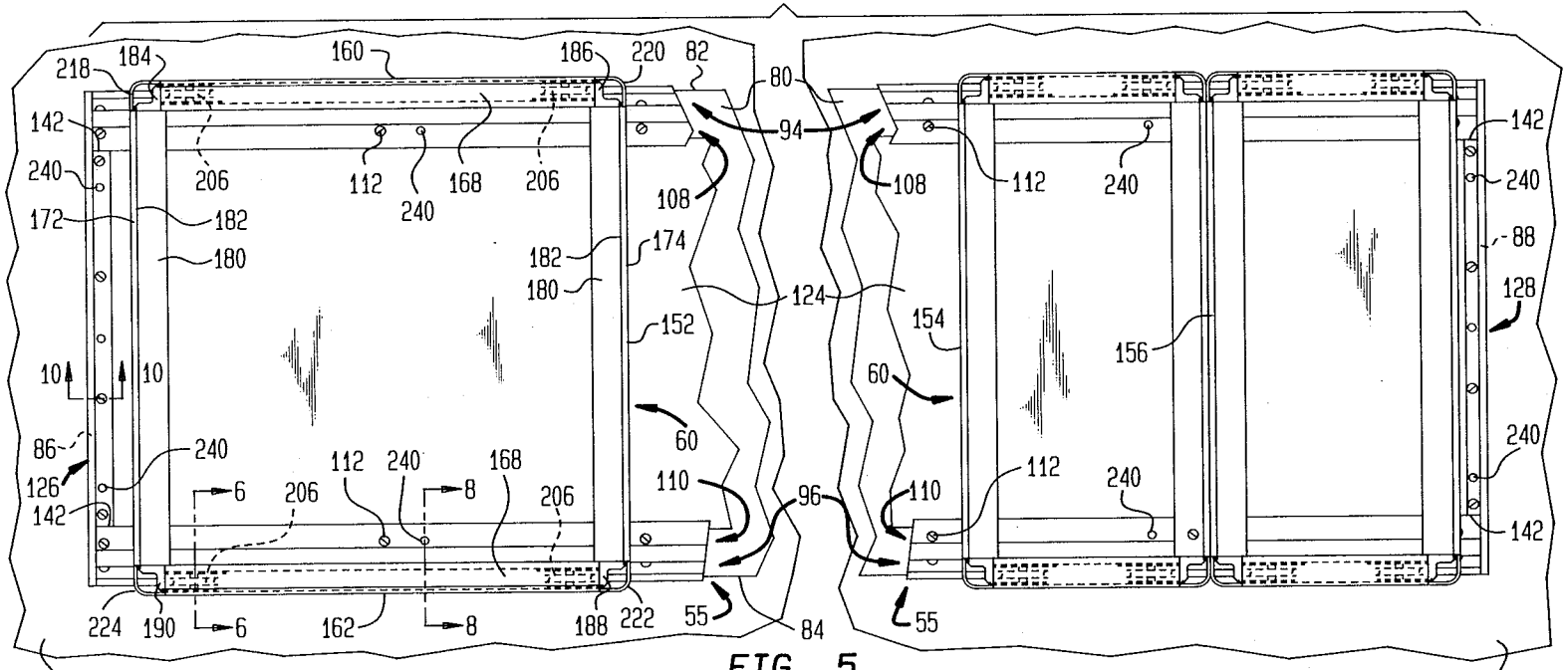
FIG. 4 is a plan view, with parts broken away for clarity, showing movable carriage assemblies and a track assembly employed in the movable cabinetry system of this invention.
Figure 5:
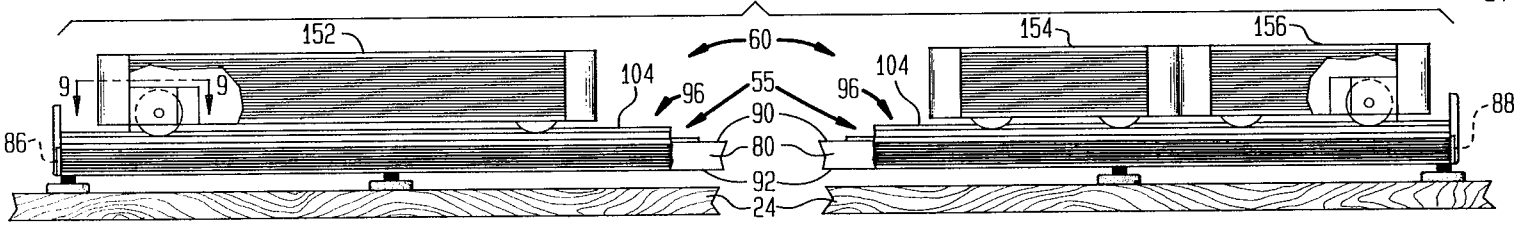
FIG. 5 is a side elevation view, with parts broken away for clarity, of the movable carriage assemblies and the track assembly shown in FIG. 4.
Figure 6:
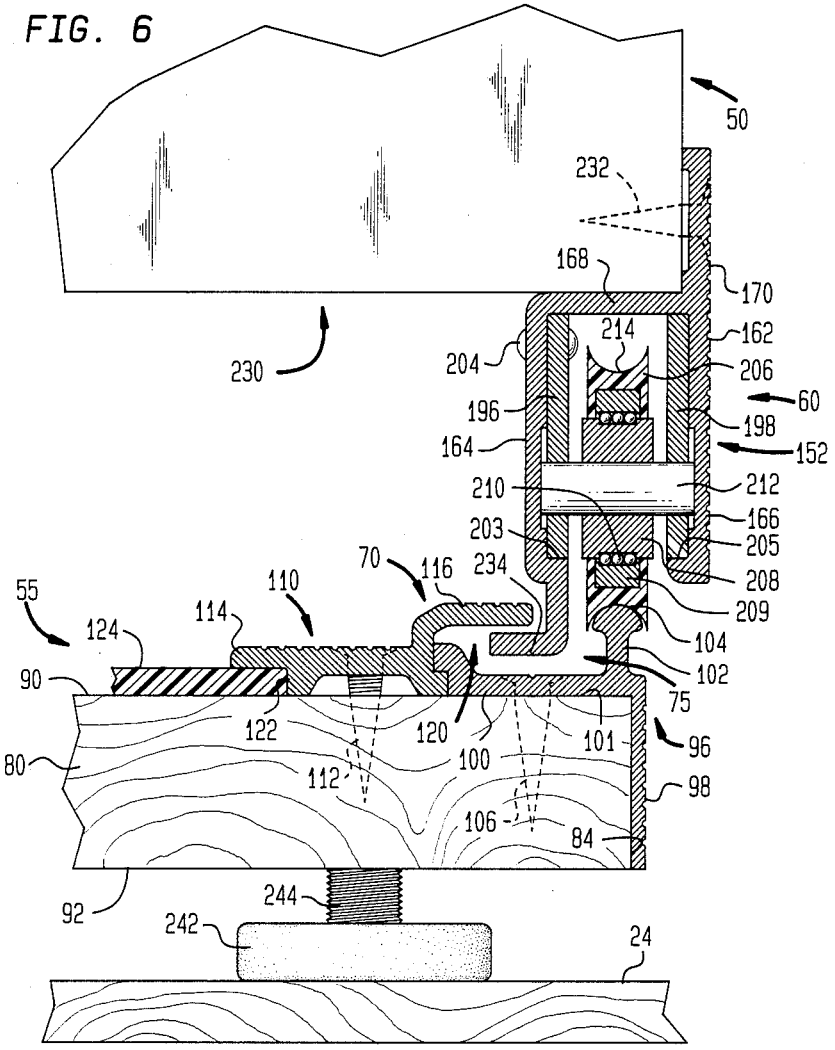
FIG. 6 is an enlarged sectional elevation view, taken along the line 6—6 of FIG. 4.
Figure 9:
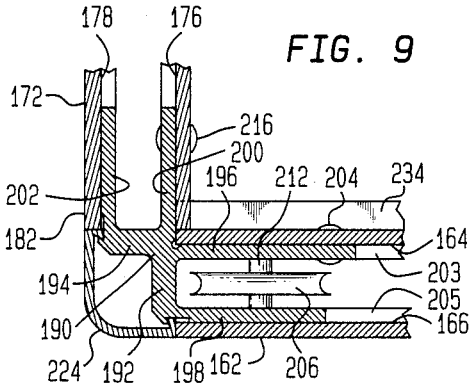
FIG. 9 is an enlarged sectional plan view, with parts omitted for clarity, taken along the line 9—9 of FIG. 5.

As shown most clearly in FIGS. 4, 6 and 9, the various carriage side members 160 and 162 and carriage end members 172 and 174 are joined to one another to form a generally rectangular assembly by means of corner connectors 184, 186, 188 and 190. The diagonally opposite corner connectors of each carriage assembly are essentially exact duplicates of one another, while the corner connectors along any one side of each carriage assembly are essentially mirror images of one another. Accordingly, this description of the corner connectors will continue with a description of corner connector 190, and that description should suffice for all of the corner connectors. As shown in FIGS. 6 and 9, the corner connector 190 includes first and second, generally "U"-shaped, portions 192 and 194, respectively. The "U"-shaped portion 192 includes vertically oriented, horizontally extending leg members 196 and 198 and the "U"-shaped portion 194 includes vertically oriented, horizontally extending leg members 200 and 202. The leg members 196 and 198 slidingly fit onto shoulders 203 and 205 in the inverted "U"-shaped channels formed within side members 160 and 162 and are fastened in place by means of rivets, one of which is shown at 204. Similarly, the leg members 200 and 202 slidingly fit onto shoulders (not shown) in the inverted "U"-shaped channel formed within carriage end members 172 and 174 and are fastened in place by means of rivets, one of which is shown at 216. The leg members 196 and 198 support between them a wheel 206 that is journaled on a hub 208 by means of a bearing race 209 and bearings 210. The hub 208, in turn, is carried on a shaft 212 that extends between the leg members 196 and 198 and is held in position therein by the leg portions 164 and 166. The wheel 206 is provided with an arcuate outer surface 214 which rides upon the arcuate surface 104 of rail 102 and prevents the carriage from moving transversely relative to the rail.

The corner connectors 184, 186, 188 and 190 are each provided with respective corner cover plates 218, 220, 222 and 224 which clip on to the corner connectors to provide smoothly curved corners interconnecting the outer surfaces of the side members and the end members of the carriage assemblies. The manner in which the corner cover plates 218–224 clip on to the corner connectors 184–190 is most clearly illustrated in FIG. 9.

From the foregoing, it will be apparent that the carriage assemblies 152, 154 and 156 each comprise generally rigid rectangular structures that are freely movable along the side rails 102 and 104 of the track assembly 55 on the wheels 206.

As indicated earlier, each of the carriage side members 160 and 162 includes a horizontally extending leg portion 168 and an upwardly extending leg portion 170, and each of the carriage end members 172 and 174 includes a horizontally extending leg portion 180 and an upwardly extending leg portion 182. The various horizontally extending leg portions 168 and 180 of the carriage assemblies 150–156 form corresponding platforms which are adapted to receive and support the bottom surfaces, shown generally at 230 (FIG. 6), of the movable cabinets 50. In addition, the upwardly extending leg portions 170 and 182 of the side members and end members, respectively, restrain the movable cabinets 50 from shifting horizontally relative to the carriage assemblies 60. As shown in FIG. 6, suitable fastening screws 232 are employed to fasten the cabinets 50 onto the carriage assembly 60 to prevent relative movement or tipping of the cabinets 50 with respect to the carriages 60.

In order to prevent the carriage assemblies 60 from tipping relative to the track assembly 50 the tilt inhibiting means 70 and 75, referred to earlier herein, are provided. The tilt inhibiting means 70 and 75 interlock with each other to inhibit tilting of the cabinets 50 relative to the track assembly 55. Thus, tile inhibiting means 70 includes the aforementioned lip member 116, which is carried by the strip cover member 110 that is fastened to the platform member 80. Similarly, tilt inhibiting means 75, carried by the carriage assembly 60, includes a horizontally extending lip member 234 integral with and carried at the lower end of the inboard leg portion 164 of each of the side members 160 and 162. The lip member 234 extends into the outwardly opening channel 120 formed between the lip portion 116 of strip cover 110 and the leg portion 100 of track members 94 and 96. The lip member 234 is free to move horizontally between the lip portion 116 and leg member 100 during normal longitudinal movement of the carriages 60 of the track assembly 55. However, should one of the movable cabinets 50 start to tip over, due for example to a heavily loaded upper drawer of the cabinet being pulled fully out of the cabinet, the lip member 234 on the carriage side member farthest away from the extended drawer would engage with the lip portion 116 to prevent the cabinet 50 from falling over and potentially injuring the user.

Figure 7:
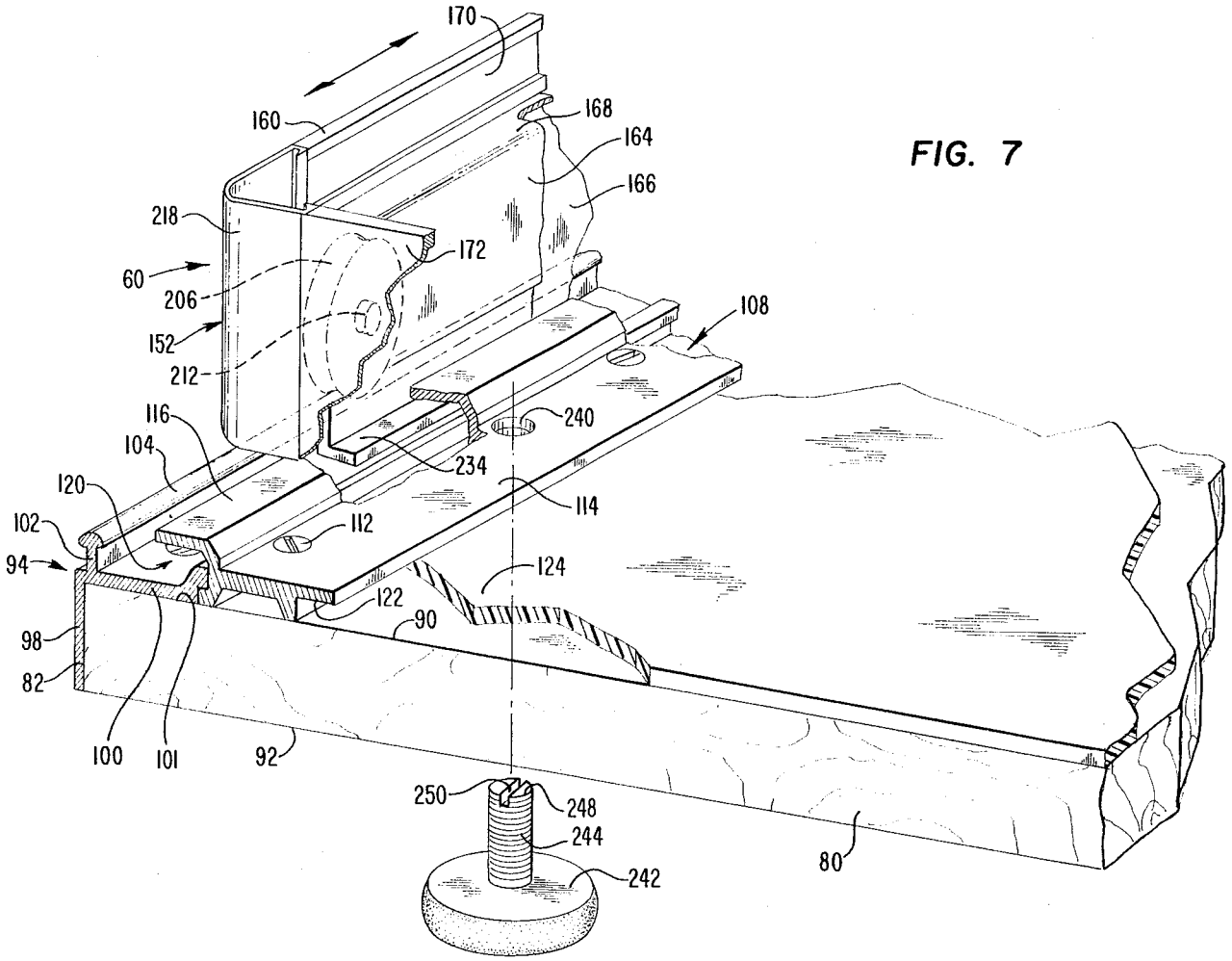
FIG. 7 is an enlarged perspective view, with parts broken away for clarity, of portions of a carriage assembly and the track assembly shown in FIG. 4.
Figure 8:
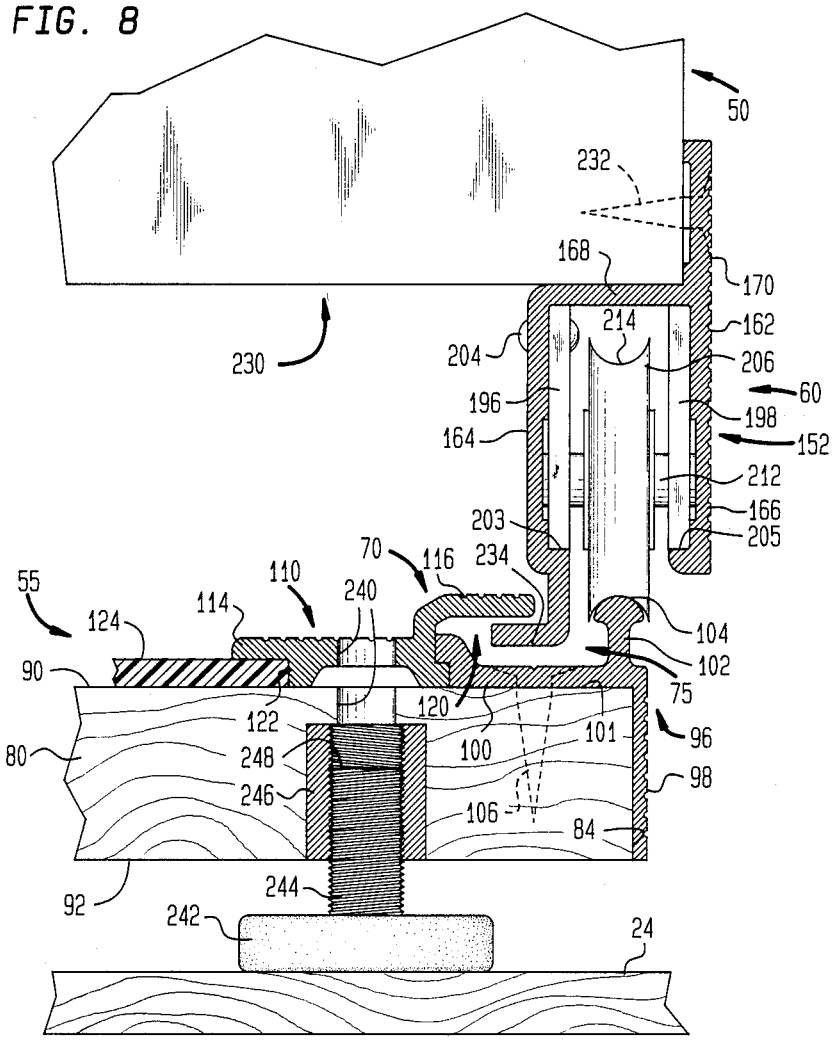
FIG. 8 is an enlarged sectional elevation view, taken along the line 8—8 of FIG. 4.

Referring to FIGS. 4, 7 and 8, a number of apertures 240 are provided at spaced points about the periphery of the track assembly 55. The apertures 240 extend through the cover strips 108 and 110 and through the end caps 126 and 128, and also extend through the platform member 80 beneath the cover strips and the end caps. The apertures 240 are employed in connection with leveling the track assembly 55 relative to the floor 24 to insure that the carriage assemblies 60 move smoothly upon the track assembly 55 and remain in place when positioned at a particular location on the track assembly.

As shown most clearly in FIGS. 7 and 8, each of the apertures 240 provides access to the upper end of a lead screw 244 that carries a leveling member 242 at its lower end. The lead screws 244 are threadedly engaged with threads formed in the interiors of inserts or nuts 246 that are fixedly carried by the platform member 80, in alignment with the apertures 240. The upper ends 248 of the lead screws 244 are provided with screwdriver slots 250 (FIG. 7) that are accessible through the apertures 240, from above, to allow the track assembly 55 to be leveled when it is being installed and at any other time that it becomes desirable for it to be re-leveled. After the track assembly 55 has been leveled, it is fastened to the floor by suitable screws or bolts (not shown) located at spaced points about its periphery to prevent it from tipping relative to the floor.

As is apparent from the foregoing description, significantly improved storage efficiency is obtained when the movable cabinetry system of the present invention is employed in an enclosure having stationary cabinetry therein. Thus, referring to FIG. 1, in the enclosure space defined by the walls 18, 20 and 22, not only the stationary cabinetry 34, 36 and 38 may be employed to store articles, but the three movable cabinets, shown generally at 252, 254 and 256 and carried by the respective carriage assemblies 152, 154 and 156, may be used to store clothing and other articles in the enclosure 10 without significantly impeding access to the stationary cabinets 34, 36 and 38. In the configuration of the movable cabinetry shown in FIG. 1 access to stationary cabinet 36 is obtainable between movable cabinets 252 and 254. Should the user desire to obtain access to stationary cabinet 34, he merely moves movable cabinet 252 to the right, as viewed in FIG. 1, until it abuts movable cabinet 254, and this provides access to cabinet 34. Should it be desired to obtain access to stationary cabinet 38, the two movable cabinets 254 and 256 are shifted to the left, as viewed in FIG. 1, into abutment with the movable cabinet 252, thereby providing access to the stationary cabinet 38.

It will thus be seen that by correlating the longitudinal lengths of the movable cabinets 252–256 to the longitudinal lengths of the stationary cabinets 34–38 access to the stationary cabinets may be had notwithstanding the presence of the movable cabinets in the enclosure. It is, of course, apparent that none of the movable cabinets 252–256 should have a longitudinal length greater than one-half the cumulative length of the stationary cabinets 34–38. This will insure that all portions of the stationary cabinets will be accessible to the user. It is also apparent that the cumulative length of the movable cabinets 252–256 should be sufficiently less than the cumulative length of the stationary cabinets 34–38 to allow for selective movement of the movable cabinets to positions that allow access to all parts of the stationary cabinetry.

From the foregoing description, it will be apparent that significantly improved storage efficiency is provided by the movable cabinetry system of the present invention. Where the movable cabinetry system is retrofitted into pre-existing enclosures, greater usable storage space is provided by the movable cabinets thereof. Similarly, in the case of new constructions, enclosures can be made more compact while still providing the same total amount of storage space therein. This arrangement, of course, allows the builder to provide more usable living space in a structure of the same square footage. Moreover, the foregoing advantages of the movable cabinetry system of the present invention are achieved without increasing the danger to users of the system since effective tilt inhibiting means are provided on the track and the carriage assemblies to avoid tipping of the movable cabinets.

While there has been shown and described what is presently considered to be the preferred embodiment of this invention, it will be obvious to those skilled in the art that various changes and modifications may be made without departing from the broader aspects of this invention. It is, therefore, aimed in the appended claims to cover all such changes and modifications as fall within the true spirit and scope of this invention.

What is claimed is:

1. In an enclosure having a plurality of walls at least one of which is elongate, a floor, door means for gaining access to said enclosure, and stationary cabinetry having elongate front and back portions, the back portion of which is positioned along and fixed in place relative to said elongate wall, a movable cabinetry system, comprising a track assembly positioned on said floor adjacent to, parallel to and coextensive with at least a major portion of the elongate front portion of said stationary cabinetry, said track assembly including a longitudinally elongate, generally rectangular platform member having transversely spaced side edges and longitudinally spaced end edges, and a pair of transversely spaced track members fastened to said platform member adjacent said corresponding side edges thereof, said track members each including a rail projecting upwardly therefrom above the plane of said platform member; at least one carriage assembly longitudinally movable on said rack assembly and adapted to support a cabinet thereon for longitudinal movement therewith, said carriage assembly being generally rectangular in plan and including a pair of transversely spaced side members, a pair of longitudinally spaced end members, and means for rigidly interconnecting said side members and said end members together, said side members each including a pair of longitudinally spaced wheels rotatably supported therein, said wheels of said carriage assembly being engageable with and rotatable on said rails of said track assembly; and means carried by one of said assemblies and engageable with the other of said assemblies for inhibiting tilting of said carriage assembly with respect to said track assembly.

2. A movable cabinetry system according to claim 1, wherein said side members and said end members of said carriage assembly are generally shaped like an inverted "U" in cross section and have downwardly extending inboard and outboard leg members, said inboard leg members of said side members each further including an inwardly projecting lip member positioned adjacent to the lower end thereof, said track assembly further including a pair of transversely spaced cover strip members fixed thereto adjacent to corresponding ones of said rails, said cover strip members each including raised outwardly facing lip members forming a channel therebeneath within which the corresponding lip members of said carriage assembly are adapted to move during longitudinal movement of said carriage assembly relative to said track assembly, said lip members of said track assembly being constructed and arranged to restrain the lip members of said carriage assembly from moving vertically relative to said track assembly, said lip members of said carriage assembly and said lip members of said track assembly together forming said means for inhibiting tilting movement of said carriage assembly relative to said track assembly.

3. A movable cabinetry system according to claim 2, wherein said track assembly further includes a pair of longitudinally spaced end members carried by said platform member adjacent said corresponding end edges thereof, said end members including upwardly projecting leg members adapted to be engaged by said carriage assembly to prevent said carriage assembly from being moved longitudinally on said track assembly beyond the end edges thereof.

4. A movable cabinetry system according to claim 3, wherein said track assembly further includes a plurality of leveling members carried thereon adjacent at least the side edges of said platform member, said leveling members being threadedly received in corresponding threaded apertures in said platform member and extending downwardly below said platform member, said leveling members being accessible through said apertures from above said platform member to facilitate in situ leveling of said platform member.

5. In an enclosure having a plurality of walls at least one of which is elongate, a floor, door means for gaining access to said enclosure, and stationary cabinetry having elongate front and back portions, the back portion of which is positioned along and fixed in place relative to said elongate wall, a movable cabinetry system, comprising a track assembly positioned on said floor adjacent to, parallel to and coextensive with at least a major portion of the elongate front portion of said stationary cabinetry, said track assembly including a longitudinally elongate generally rectangular platform member having transversely spaced side edges and longitudinally spaced end edges, a pair of transversely spaced track members fastened to said platform member adjacent said corresponding side edges thereof, said track members each including a rail projecting upwardly therefrom above the plane of said platform member; a plurality of carriage assemblies longitudinally movable on said track assembly and adapted to support corresponding cabinets thereon for longitudinal movement therewith, each of said carriage assemblies being generally rectangular in plan and including a pair of transversely spaced side members, a pair of longitudinally spaced end members, and means for rigidly interconnecting said side members and said end members together, said side members each including a pair of longitudinally spaced wheels rotatably supported therein, said wheels of said carriage assembly being engageable with and rotatable on said rails of said track assembly, the cumulative longitudinal length of said carriage assemblies being sufficiently less than the longitudinal length of the front portion of said stationary cabinetry so that cabinets supported by said carriage assemblies and having longitudinal lengths corresponding to the longitudinal lengths of said carriage assemblies can be moved relative to said stationary cabinetry to allow access to substantially all of the front portion of said stationary cabinetry; and means carried by one of said assemblies and engageable with another of said assemblies for inhibiting tilting of said carriage assemblies with respect to said track assembly, said tilt inhibiting means comprising interlocking means carried by each of said carriage assemblies and by said track assembly, said interlocking means of said carriage assemblies being engageable with said interlocking means of said track assembly when said carriage assemblies are tilted with respect to said track assembly to inhibit tilting of the carriage assemblies beyond a predetermined minimum amount relative to said track assembly.

6. A movable cabinetry system according to claim 5, wherein said side members and said end members of said carriage assemblies are generally shaped like an inverted "U" in cross section and have downwardly extending inboard and outboard leg members, said inboard leg members of said side members each further including an inwardly projecting, generally horizontal lip member positioned adjacent the lower end thereof, said track assembly further including a pair of transversely spaced cover strip members fastened thereto adjacent to corresponding ones of said rails, said cover strip members each including raised outwardly facing lip members forming a channel therebeneath within which the corresponding lip members of said carriage assemblies are adapted to move during longitudinal movement of said carriage assemblies relative to said track assembly, said lip members of said track assembly being constructed and arranged to restrain the lip members of said carriage assemblies from moving vertically relative to said track assemblies, said lip members of said carriage assemblies and said lip members of said track assembly together forming said interlocking means for inhibiting tilting movement of said carriage assemblies relative to said track assembly.

7. A movable cabinetry system, comprising a longitudinally elongate track assembly, at least one carriage assembly longitudinally movable on said track assembly and adapted to support a cabinet thereon for longitudinal movement therewith, and means carried by one of said assemblies and engageable with the other of said assemblies for inhibiting tilting of said carriage assembly with respect to said track assembly, wherein said carriage assembly is generally rectangular in plan and includes a pair of transversely spaced side members, a pair of longitudinally spaced end members, and means for rigidly interconnecting said side members and said end members together, said side members each including a pair of longitudinally spaced wheels rotatably supported therein, said side members and said end members of said carriage assembly being generally shaped like an inverted "U" in cross section and having downwardly extending inboard and outboard leg members, said inboard leg members of said side members each further including an inwardly projecting lip member positioned adjacent to the lower end thereof, and wherein said track assembly includes a longitudinal elongate, generally rectangular platform member having transversely spaced side edges and longitudinally spaced end edges, and a pair of transversely spaced track members fastened to said platform member adjacent said corresponding side edges thereof, said track members each including a rail projecting upwardly therefrom above the plane of said platform member, said wheels of said carriage assembly being engageable with and rotatable on said rails, said track assembly further including a pair of transversely spaced cover strip members fixed thereto adjacent to corresponding ones of said rails, said cover strip members each including raised outwardly facing lip members forming a channel therebeneath within which the corresponding lip members of said carriage assembly are adapted to move during longitudinal movement of said carriage assembly relative to said track assembly, said lip members of said track assembly being constructed and arranged to restrain the lip members of said carriage assembly from moving vertically relative to said track assembly, said lip members of said carriage assembly and said lip members of said track assembly together forming said means for inhibiting tilting movement of said carriage assembly relative to said track assembly.

8. A movable cabinetry system according to claim 7, wherein said track assembly further includes a pair of longitudinally spaced end members carried by said platform member adjacent corresponding side edges thereof, said end members including upwardly projecting leg members adapted to be engaged by said carriage assembly to prevent said carriage assembly from being moved longitudinally on said track assembly beyond the end edges thereof.

9. A movable cabinetry system according to claim 8, wherein said track assembly further includes a plurality of leveling members carried thereon adjacent the side edges and end edges of said platform member, said leveling members being threadedly received in corresponding threaded apertures in said platform member and extending downwardly below said platform member, said leveling members being accessible through said apertures from above said platform member to facilitate in situ leveling of said platform member.

10. A movable cabinetry system, comprising a track assembly including an elongate generally rectangular platform member having transversely spaced side edges, longitudinally spaced end edges and upper and lower surfaces, a pair of transversely spaced track members fastened to said platform member adjacent said corresponding side edges thereof, each of said track members including a rail projecting upwardly therefrom above the upper surface of said platform member, and a pair of cover strip members carried by said platform member adjacent to said track members, each of said cover strip members including a raised, horizontally extending lip thereon which overlies a portion of a corresponding one of said track members to form an outwardly opening channel therewith; and at least one generally rectangular carriage assembly longitudinally movable on said track assembly and adapted to support a cabinet thereon for longitudinal movement therewith, said carriage assembly having a said track assembly, said carriage assembly including a pair of transversely spaced side members, a pair of transversely spaced end members, and means for rigidly interconnecting said side members and said end members together, said side members each including a pair of longitudinally spaced wheels rotatably supported therein, said wheels being engagable with and rotatable on said rails, said side members each including a horizontally extending, inwardly facing lip thereon which extends into a corresponding one of said channels on said track assembly when said carriage assembly is on said track assembly to inhibit tilting of said carriage assembly relative to said track assembly.

* * * * *

UNITED STATES PATENT AND TRADEMARK OFFICE

CERTIFICATE OF CORRECTION

PATENT NO. : 4,789,210

DATED : Dec. 6, 1988

INVENTOR(S) : Weiss et al

It is certified that error appears in the above-identified patent and that said Letters Patent is hereby corrected as shown below:

Column 4, line 26, "borad" should read --board--.
Column 8, line 16, "rack" should read --track--.
Column 12, line 5, after "a", insert --longitudinal length no greater than about one-half the length of --.

Signed and Sealed this

Twenty-eighth Day of November 1989

*Attest:*

JEFFREY M. SAMUELS

*Attesting Officer* *Acting Commissioner of Patents and Trademarks*